United States Patent [19]

Smith

[11] Patent Number: 4,838,613

[45] Date of Patent: Jun. 13, 1989

[54] WATER CHAIR

[76] Inventor: Peter A. Smith, 593 Princes Highway, Rockdale, New South Wales 2216, Australia

[21] Appl. No.: 162,758

[22] Filed: Mar. 1, 1988

[30] Foreign Application Priority Data

Mar. 19, 1987 [AU] Australia ..... PI0956

[51] Int. Cl.[4] ..... A47C 7/02

[52] U.S. Cl. ..... 297/452; 5/455; 297/DIG. 2; 297/DIG. 3

[58] Field of Search ..... 297/452, 416, 220, DIG. 2, 297/DIG. 3, 455; 5/455, 451

[56] References Cited

U.S. PATENT DOCUMENTS

| | | | |
|---|---|---|---|
| 3,689,949 | 9/1972 | Weinstein | 297/DIG. 3 |
| 4,206,945 | 6/1980 | Kifferstein | 297/220 |
| 4,370,769 | 2/1983 | Herzig | 5/455 X |
| 4,391,466 | 7/1983 | Smith | 297/452 |
| 4,699,424 | 10/1987 | Andres et al. | 297/DIG. 3 |
| 4,738,486 | 4/1988 | Surber | 297/DIG. 3 |

*Primary Examiner*—James T. McCall

*Attorney, Agent, or Firm*—Ostrolenk, Faber, Gerb & Soffen

[57] ABSTRACT

A water chair which is particularly suitable for use by convalescent or geriatric persons and which comprises a frame having a seat portion and a backrest portion, a plurality of bag-like slings secured by their upper edges to the backrest portion, and a water impermeable bag located wholly within each sling. The bag within each sling is partially filled with water and the space within each bag which is not occupied by the water is substantially free of air whereby the bag and its containing sling will function as a cushion which supports and adapts to the shape of a user of the chair. The bag within each sling is secured to and suspended within the sling so that it does not collapse upon itself when partially filled with water.

13 Claims, 4 Drawing Sheets

WATER CHAIR

FIELD OF THE INVENTION

This invention relates to a chair which has backrest cushions in the form of water bags and which is herein referred to as a "water chair". The water chair may be constructed in various forms, for example, as a single-seat chair or as a multi-seat lounge, and it may be manufactured for use in a variety of situations. For example, the water chair may be constructed in a relatively simple way for use in a domestic residence or in a more sophisticated form so that it may be used by convalescent or geriatric persons who, whilst seated, required gentle support over substantially the full length of their bodies.

BACKGROUND OF THE INVENTION

A water chair of the general type to which the present invention relates is disclosed in Australian Patent No. 527133 and corresponding U.S. Pat. No. 4,391,466. These patents relate to a water chair having back support cushions which are constituted by sling-supported water bags. The slings are attached in overlapping relationship to a hard, flat back of the chair and the water bags are located freely within the slings. A seat cushion for the chair is formed in a similar way, in the sense that it comprises a water bag which is located within a containing bag or cover, and the cushion is carried by a hard, flat support.

The water chair which is described and claimed in the referenced patents has received widespread approval, particularly when used by geriatrics who suffer pressure point discomfort when seated in conventionally upholstered chairs. However, it has been found that the water bags are subjected to considerable stress when water is displaced by concentrated forces and there is a risk that welded seams in the water bags might be subjected to such high stresses that they will burst. Also, it has been found that the water bags tend to fold or crease within the slings and that fatigue induced cracks can occur along the fold lines.

SUMMARY OF THE INVENTION

The present invention seeks to alleviate this problem by providing a chair which comprises a frame having a seat portion and a backrest portion. At least one bag-like sling is secured to the backrest portion, the or each sling being attached adjacent its upper edges to the backrest portion, and a water impermeable bag is located within and is enveloped by the or each sling. Each water bag is partially filled with water and air is exhausted from the region of the bag which is not occupied by water whereby such water bag and containing sling will function as a cushion which supports and adapts to the shape of a user of the chair. Also, the water bag within the or each sling is secured to and suspended within the sling so that it does not collapse upon itself and form stress concentrating fold lines.

PREFERRED FEATURES OF THE INVENTION

Velcro strips may be used for securing the water bag within its associated sling, but the water bag preferably is adhered in position within the sling.

In a particularly preferred construction two or more slings are secured to the backrest portion of the chair, the slings being located one above the other, in either spaced-apart or overlapping relationship.

The total volumetric capacity of each water bag is preferably substantially equal to or slightly greater than that of its containing sling, so that any water displacement force which tends to expand the water bag will be transferred to the enveloping sling. Thus, the sling functions to prevent localised expansion of the water bag and to prevent stress-induced rupturing of the bag.

The slings, and the water bags which are contained within the slings, are preferably covered by an upholstery material so that the slings themselves are not actually contacted by a person seated on the chair. In addition to its normal "covering" function, the upholstery material serves to a small extent to distribute forces which are exerted by a person who is seated on the chair and to prevent or reduce the application of concentrated forces on the sling-supported water bags.

The chair in accordance with the present invention preferably has a seat cushion which also is formed by locating a partially filled water bag within an enveloping cover. Here again, the water bag preferably has a total volumetric capacity approximately equal to or slightly greater than that of the covering, so that the water bag is at all times constrained against excessive expansion.

The invention will be more fully understood from the following description of a preferred embodiment of a water chair, the description being given with reference to the accompanying drawings.

DETAILED DESCRIPTION OF THE INVENTION

Figure 1:
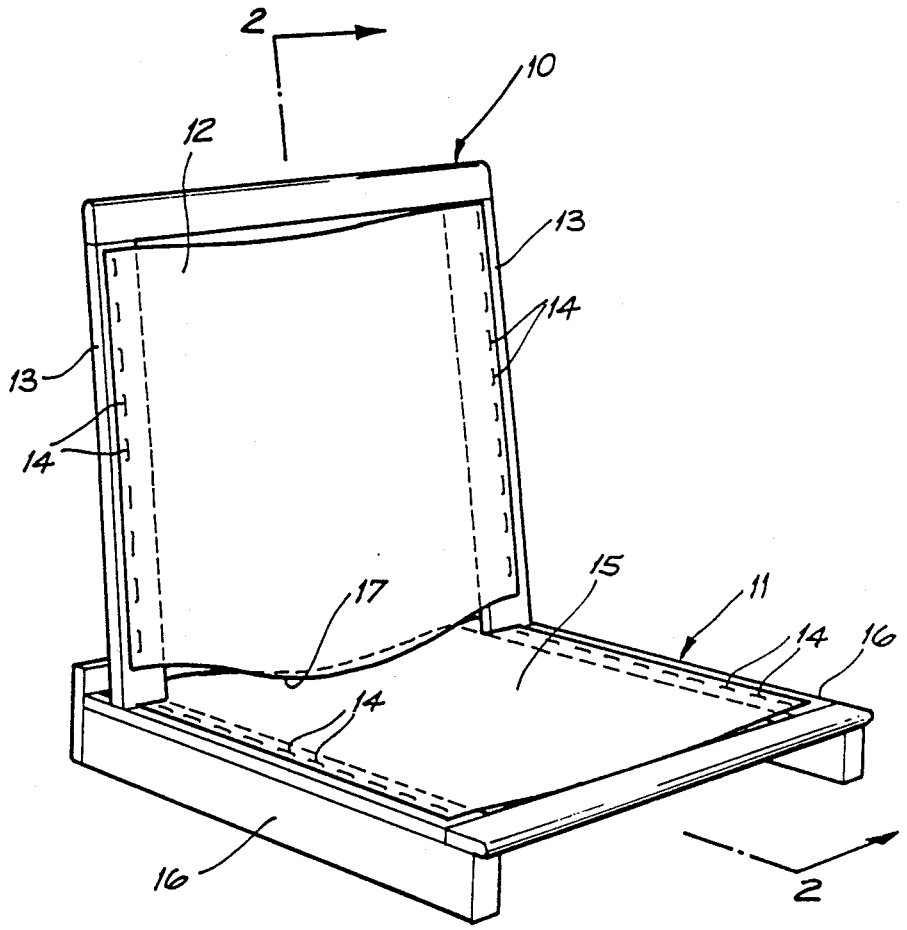
FIG. 1 shows a diagrammatic representation of the seat and backrest portions of a metal, plastic or timber-framed chair prior to the fixing of (slung) cushions and u material.

As illustrated, the water chair comprises a frame structure having backrest and seat portions 10 and 11. An elementary structure only is shown in the drawings for convenience of reference.

A sheet 12 of reinforced plastics material extends between side members 13 of the backrest and is secured to the side members by staples 14. A similar sheet 15 extends between and is stapled to side rails 16 of the seat portion. The backrest sheet 12 has a tail portion 17 extending along its lower edge, the tail portion being intended to project forwardly of the backrest and to overlie a seat cushion 18 (FIG. 2) of the chair.

Figure 2:
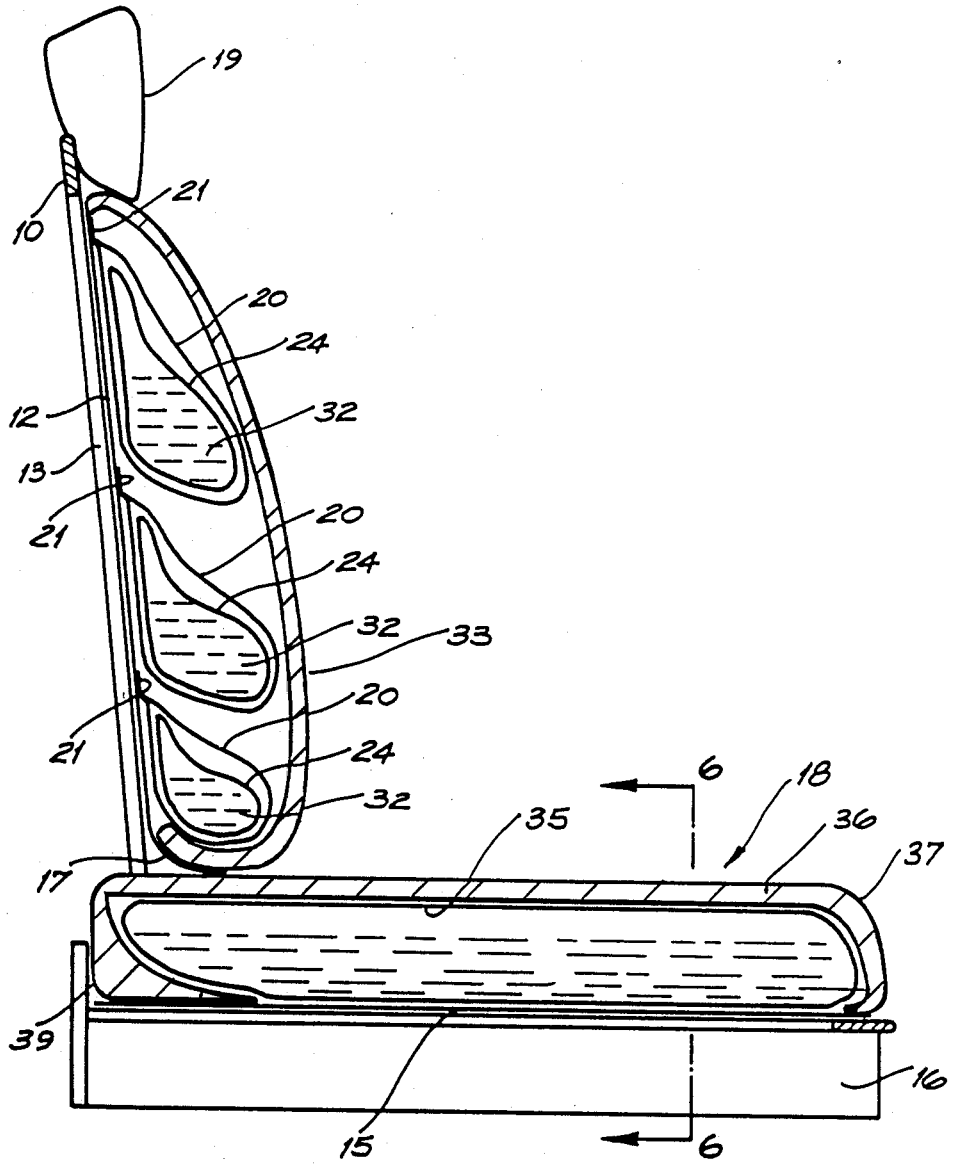
FIG. 2 shows a sectional elevation view of the chair, as viewed in the direction of section plane 2—2 of FIG. 1, when fitted with water bag cushions and upholstery.
Figure 3:
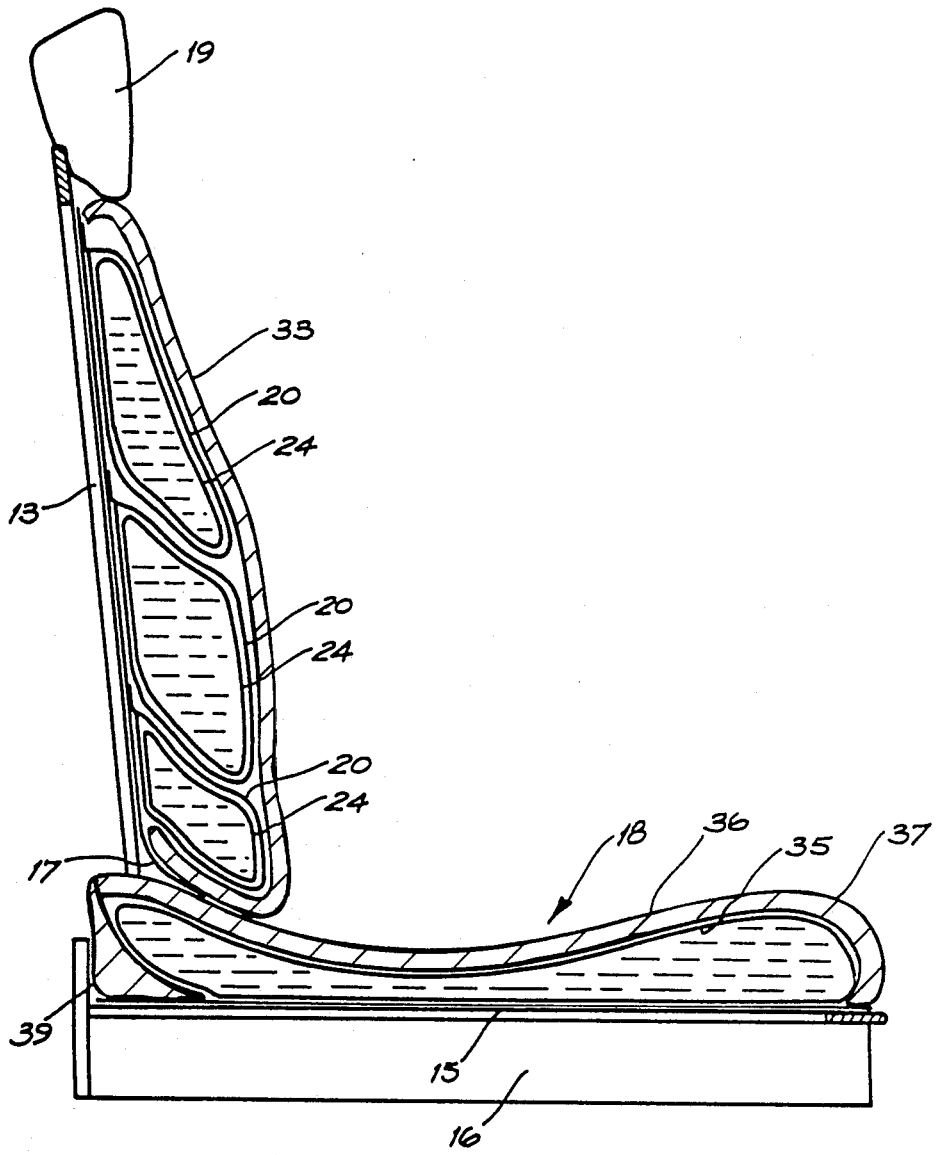
FIG. 3 shows a view which is similar to FIG. 2 but with deformable portions of the chair forced into a body-conforming shape.

As shown in FIGS. 2 and 3 of the drawings, a padded head rest 19 is attached to an upper rail of the backrest portion 10 of the chair, and three slings 20 are secured to the sheet 12 which extends across the backrest of the chair. The slings 20 extend for substantially the full width of the backrest portion of the chair, they lie parallel to one another and they are secured to the backrest by sewing, welding or gluing an upper marginal edge 21 of each of the slings to the sheet 12.

Figure 4:
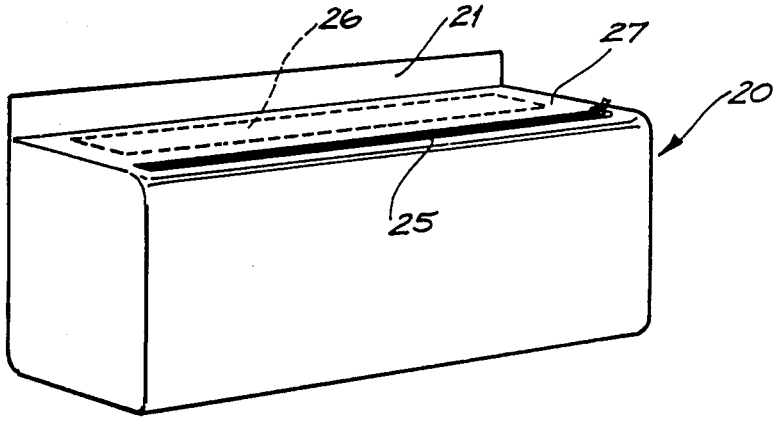
FIG. 4 shows a view of a sling when in an uncollapsed condition, the sling being removed from the backrest portion the chair.
Figure 5:
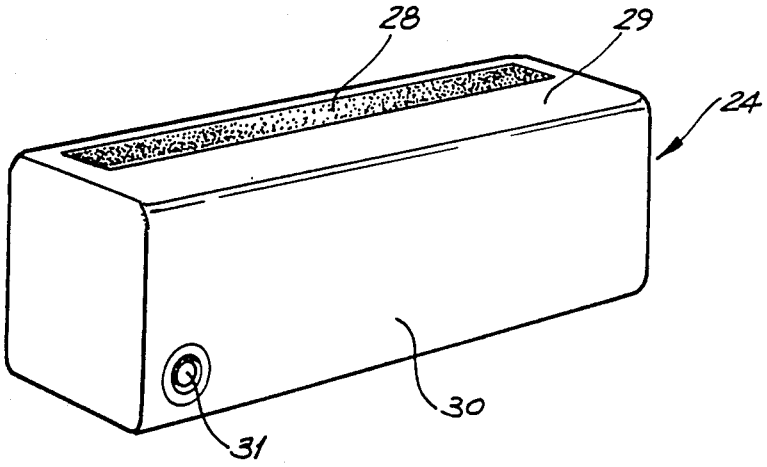
FIG. 5 shows a perspective view of a water bag when in an uncollapsed condition, the water bag being removed from its containing sling.

The slings 20 are made from a strong fabric, such as canvas, gabardine or a reinforced plastics sheet material. When in an uncollapsed condition, as shown in FIG. 4, each sling has a generally oblong shape.

Each sling 20 forms a compartment for one water bag 24, and the sling is provided with a zippered opening 25 to permit the water bag 24 to be located within the sling. A Velcro strip 26 is secured to the inside surface of the top panel 27 of each sling, and the strip 26 is intended to contact a mating strip 28 which is secured to the upper panel 29 of the water bag 24. Mating of the Velcro strip components 26 and 28, when the water bag 24 is located within the sling 20, prevents the water bag from collapsing within the sling. As an alternative to the use of Velcro strips, the upper panel 29 of the water bag may be (and preferably is) glued to the inside surface of the top panel of the sling.

Each water bag 24 has a generally oblong form and it is fabricated from a water impermeable plastics sheet material. The various panels of the water bag, including the back panel 29, are welded together, and the front panel 30 is fitted with a capped opening 31 through which water can be admitted to partially fill the bag.

Each water bag 24 has a total volumetric capacity which is approximately equal to or slightly greater than that of the associated sling. With this arrangement, the sling will prevent the water bag from being expanded beyond the total internal volume of the sling and, thus, the water bag will not be subjected to significant elastic expansion. This means that the welded seams within the water bags 24 will not be subjected to rupturing stresses if the bags are subjected to concentrated loads, as may be the case if a heavy person "throws" himself or falls into the chair.

When not influenced by an external load, the slings 20 will tend to just hang from the back of the chair and, because of the static mass of water within the contained water bags 24, the slings 20 will adopt a configuration substantially as shown in FIG. 2 of the drawings. Thus, water lying in the lower portion of each of the water bags causes the water bags and containing slings to adopt a bottom-heavy bulbous shape.

The water bags 24 are partially filled with water 32, so that the water occupies something less than 90% of the total internal volume of the bags, and residual air is exhausted from the remaining space in each of the bags. Then, when a person sits on the chair and leans against the backrest, the water 32 within the bags is displaced, and both the water bags 24 and the slings 20 adapt to the shape of the user. This condition is shown in FIG. 3 of the drawings.

The water bags 24 and their containing slings 20 are concealed from sight by an outer covering 33. The covering folds under the lowermost sling 20, and it may be attached to the top of the chair and to each side of the backrest by way of Velcro tabs. The covering 33 forms a part of the chair upholstery and it is fashioned from an outer fabric or leather cladding on a foamed plastics material sheet.

The seat cushion 18 is formed in a manner somewhat similar to the back cushions, in the sense that it comprises a totally enclosed water bag 35.

Figure 6:
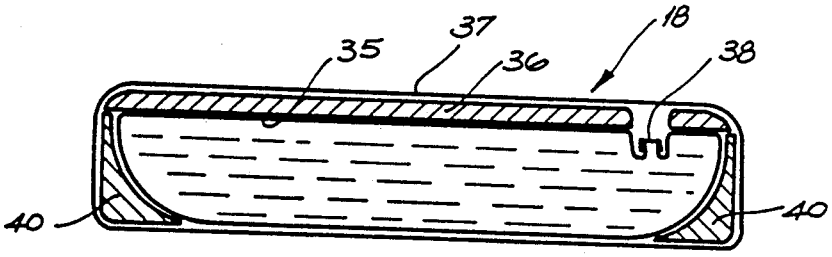
FIG. 6 shows a sectional elevation view of a seat cushion of the chair as seen in the direction of section plane 6—6 of FIG. 2.

The water bag 35 is formed from a water impervious plastics material sheet which is fitted with a capped opening 38 (FIG. 6) through which water is poured to partially fill the bag. The top and front faces of the water bag 35 are clad with a foamed plastics material sheet 36, and the entire structure is totally enveloped by an outer covering 37.

The outer covering 37 may comprise a fabric or a leather sheet and, in any case, forms a part of the chair's upholstery. Although not shown in the drawings, the outer covering 37 is fitted with a circumferentially extending zip fastener which may be opened to permit assembly of the water bag 35 into the outer covering. Wedge-shaped support elements 39 and 40 which are formed from foamed plastics material are located within the covering 37 and serve to support the back and side edges of the water bag 35.

As in the case of the backrest cushions, the water bag 35 of the seat cushion has a total contained volume which is substantially equal to or slightly greater than that of the covering 37 so that, when subjected to a deforming force, the water bag is not stressed elastically. Forces which are applied to the seat cushion as a result of a person sitting on the seat and which might tend to stretch the water bag cause the water bag to occupy the full volume of the covering 37 and to be constrained by the covering before the bag is subjected to an excessive elastic stress.

The seat cushion extends under and beyond the backrest cushions, and the lower marginal tail 17 of the backrest sheet 12 lies between the seat cushion and the backrest cushion. This results in an arrangement which functions as an integral unit rather than as two separate cushions which might otherwise interfere with one another or move independently of one another, and both the seat cushion and the backrest cushion move together to conform to the shape of a person who sits on the chair.

I claim:

1. A water chair comprising a frame having a seat portion and a backrest portion, a bag-like sling secured to the backrest portion, the sling being attached adjacent its upper edge to the backrest portion, a water impermeable bag located within and enveloped by the sling, the bag being partially filled with water and the space within the bag which is not occupied by water being substantially free of air whereby the bag and containing sling will function as a cushion which supports and adapts to the shape of a user of the chair, and the bag within the sling being secured to and suspended within the sling so that it does not collapse upon itself when partially filled with the water.

2. A water chair comprising a frame having a seat portion and a backrest portion, a plurality of bag-like slings secured to the backrest portion, each sling being attached adjacent its upper marginal edge to the backrest portion, a water impermeable bag located within and enveloped by each sling, each bag being partially filled with water and the space within each bag which is not occupied by water being substantially free of air whereby the bag and containing sling will function as a cushion which supports and adapts to the shape of a user of the chair, and the bag within each sling being secured to and suspended within the sling so that it does not collapse upon itself when partially filled with the water.

3. Water chair as claimed in claim 2 wherein the total volumetric capacity of each bag is substantially equal to or slightly greater than that of each containing sling.

4. A water chair as claimed in claim 2 wherein each sling extends substantially the full width of the backrest portion of the chair and is secured to the backrest portion of the chair by sewing, welding or gluing an upper marginal edge of the sling to the backrest portion.

5. A water chair as claimed in claim 2 wherein each bag is secured in position within its associated sling by an adhesive.

6. A water chair as claimed in claim 2 wherein each bag is secured in position within its associated sling by a Velcro strip secured to the inside surface of a top panel of the sling to contact a mating strip which is secured to an upper panel of the bag.

7. A water chair as claimed in claim 2 wherein the bag when in an uncollapsed form has substantially the same shape as its containing sling when in an uncollapsed form.

8. A water chair as claimed in claim 1 wherein a seat cushion comprising a partially filled water impermeable bag within an enveloping cover is located on the seat portion of the chair.

9. A water chair as claimed in claim 8 wherein the bag has a total volumetric capacity approximately equal to or slightly greater than that of the cover.

10. A water chair as claimed in claim 2 wherein a reinforced plastics material extends between and is secured to substantially parallel side members of the backrest portion and the seat portion of the frame, the plastics material of the backrest portion having a tail portion which overlays the rear edge of the seat portion such that the seat cushion extends under and beyond the backrest portion, the lower tail portion of the backrest portion lying between the seat cushion and the backrest cushion.

11. A water chair as claimed in claim 2 wherein a seat cushion comprising a partially filled water impermeable bag within an enveloping cover is located on the seat portion of the chair.

12. A water chair as claimed in claim 1, further comprising upholstery over the backrest portion and covering over the sling which forms a portion of the upholstery.

13. A water chair as claimed in claim 2, further comprising upholstery over the backrest portion and covering over the sling which forms a portion of the upholstery.

* * * * *